US006130689A

United States Patent [19]

Choi

[11] Patent Number: 6,130,689

[45] Date of Patent: Oct. 10, 2000

[54] APPARATUS AND ACTUATOR FOR INJECTING A RECORDING SOLUTION OF A PRINT HEAD AND METHOD FOR PRODUCING THE APPARATUS

[75] Inventor: Hae Yong Choi, Kyunggi-do, Rep. of Korea

[73] Assignee: Samsung Electro-Mechanics Co., Ltd., Kyunggi-do, Rep. of Korea

[21] Appl. No.: 08/974,688

[22] Filed: Nov. 19, 1997

[51] Int. Cl.[7] ..... B41J 2/04

[52] U.S. Cl. ..... 347/54

[58] Field of Search ..... 347/55, 54, 62, 347/65, 66, 67, 68, 75; 399/243

[56] References Cited

U.S. PATENT DOCUMENTS

| | | | |
|---|---|---|---|
| 5,622,897 | 4/1997 | Hayes | 347/72 |
| 5,804,083 | 9/1998 | Ishii et al. | 347/54 |

FOREIGN PATENT DOCUMENTS

| | | | |
|---|---|---|---|
| 0 718 102 A2 | 6/1996 | European Pat. Off. | 347/54 |
| 57-203177 | 12/1982 | Japan . | |
| 63-57251 | 11/1988 | Japan . | |
| 2-265752 | 10/1990 | Japan . | |
| 2-308466 | 12/1990 | Japan . | |
| 2-65349 | 3/1991 | Japan . | |
| 4-247680 | 9/1992 | Japan . | |

OTHER PUBLICATIONS

Hirata et al., "An ink–jet Head using Diaphragm Microactuator", Jun. 1996 IEEE.

*Primary Examiner*—John Barlow
*Assistant Examiner*—Raquel Yvette Gordon
*Attorney, Agent, or Firm*—Lowe Hauptman Gopstein Gilman & Berner

[57] ABSTRACT

In an apparatus and method for injecting a recording solution of a print head, a second thin film capable of regulating deforming quantity and buckling force of a vibration plate is coupled to a thin film shape memory alloy by using a semiconductor thin film fabricating process to increase the buckling force when the thin film shape memory alloy is cooled down to be buckled to its initial bending-deformed state. Thus, the time taken for buckling to the bending-deformed state of the vibration plate after injecting the recording solution is reduced and the operating frequency is increased to heighten printing speed, and rigidity of the vibration plate is heightened to reduce a concern about a damage by an external shock. The apparatus includes vibration plates having a thin film shape memory alloy of a shape memory alloy phase-transformed by a temperature variation and at least one second thin film coupled to the thin film shape memory alloy for regulating the phase transforming quantity, an electric power supply section for inciting the temperature variation of the thin film shape memory alloy, a passage plate is installed over the thin film shape memory alloy while being formed with liquid chambers for retaining the recording solution and a feed path in one sides of wall planes surrounding the liquid chambers for introducing the recording solution, and a nozzle plate installed over the passage plate and formed with nozzles smaller than the liquid chambers of the passage plate for injecting the recording solution in the form of droplet when the phase of the vibration plate is transformed.

34 Claims, 13 Drawing Sheets

(heating time)

(cooling time)

(heating time)

(cooling time)

FIG. 13(A)
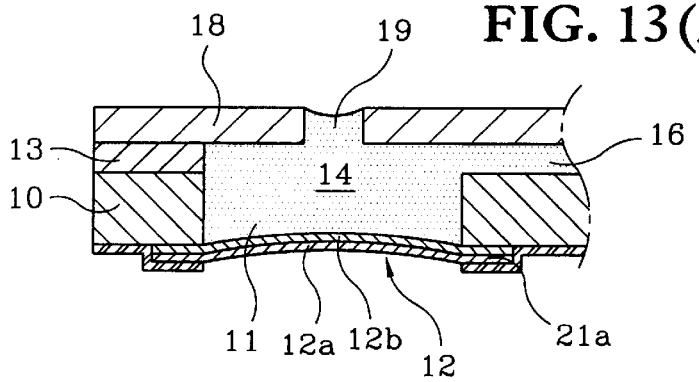
FIG. 13(B)
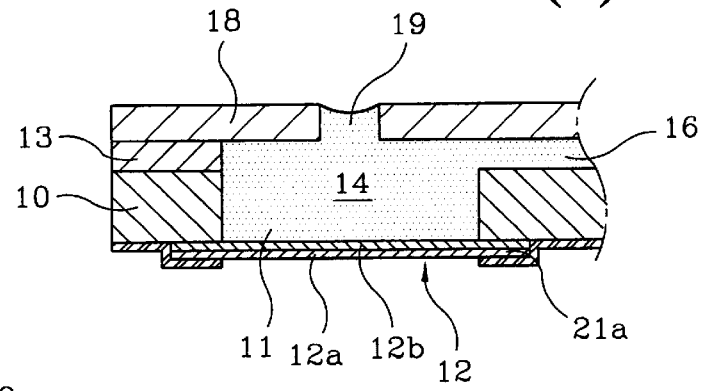
FIG. 13(C)
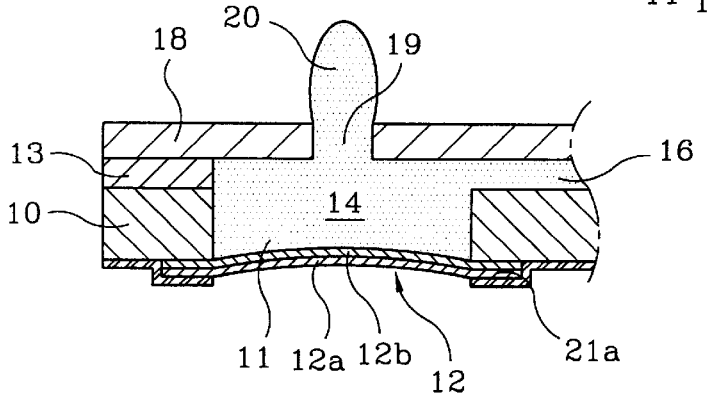
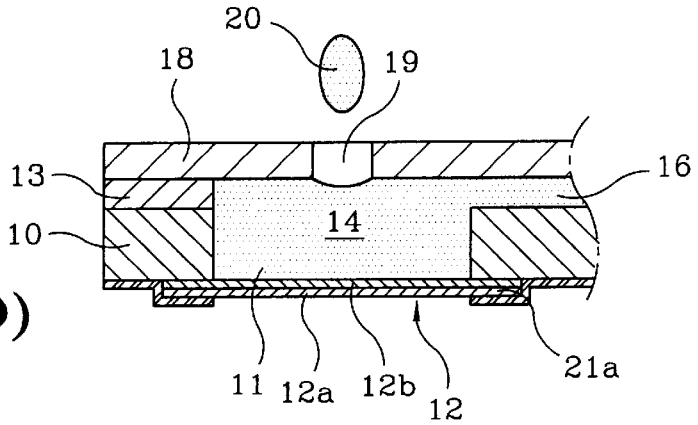
FIG. 13(D)

APPARATUS AND ACTUATOR FOR INJECTING A RECORDING SOLUTION OF A PRINT HEAD AND METHOD FOR PRODUCING THE APPARATUS

BACKGROUND OF THE INVENTION

1. Field of the Invention

The present invention relates to an apparatus for injecting a recording solution of a print head, and more particularly to an apparatus for injecting a recording solution of a print head, wherein, a vibration plate is vibrated in accordance with a temperature variation of a thin film shape memory alloy to regulate a pressure of a liquid chamber, and a second thin film having a residual compressive stress is deposited onto the thin film shape memory alloy for permitting a deforming quantity of the vibration plate to be easily controlled and a buckling force to be controlled, thereby increasing operating frequency to enhance printing performance, enabling to manufacture products small in size and simple in structure, and utilizing a semiconductor thin film fabricating process to be distinguished in mass production.

2. Description of the Prior Art

Widely available print heads generally utilize a Drop On Demand (DOD) system. The DOD system has been increasingly employed since the printing operation is easily performed by instantaneously injecting bubbles of recording solution under the atmospheric pressure neither requiring the charge or deflection of the bubbles of the recording solution nor demanding high pressure. A heating-type injecting method using a resistor and a vibrating-type injecting method using a piezo-electric device may be given as the representative injecting principles.

FIG. 1 is a view for explaining the heating-type injecting method, in which a chamber a1 retains a recording solution therein, an injection hole a2 directing from chamber a1 toward a recorded medium is provided, and a resistor a3 is embedded into the bottom of chamber a1 to be opposite to injection hole a2 to incite expansion of air. By this construction, the air bubbles expanding by resistor a3 are to forcibly push the recording solution within the interior of chamber a1 through injection hole a2, and the recording solution is injected toward the recorded medium by the pushing force.

In terms of the thermal-type injecting method, however, the recording solution is heated to cause a chemical change. Furthermore, the recording solution adversely adheres onto the inner circumference of injection hole a2 to clog it. In addition to a drawback of short durability of the heat-emitting resistor, the water-soluble recording solution should be utilized to degrade maintainability of a document.

FIG. 2 is a view for explaining the vibrating-type injecting method by means of the piezo-electric device, which is constructed by a chamber b1 for retaining a recording solution, an injection hole b2 directing from chamber b1 toward a recorded medium, and a piezo transducer b3 buried into the bottom of the opposite side of injection hole b2 for inciting vibration.

Once piezo transducer b3 incites vibration at the bottom of chamber b1, the recording solution is forcibly pushed out through injection hole b2 by the vibrating force. Consequently, the recording solution is injected onto the recorded medium by the vibrating force.

Without using the heat, the injecting method by means of the vibration of the piezo transducer is advantageous of selecting a variety of recording solutions. However, the processing of the piezo transducer is difficult and, especially, the installing of the piezo transducer attached to the bottom of chamber b1 is a demanding job to be detrimental to mass production.

Additionally, the conventional print head employs a shape memory alloy for issuing the recording solution. Japanese Laid-open Patent Publication Nos. sho 57-203177, sho 63-57251, hei 4-247680, hei 2-265752, hei 2-308466 and hei 3-65349 disclose examples print heads employed with shape memory alloys. The conventional examples are constructed to be bending-deformed by joining several sheets of shape memory alloys respectively having different phase transforming temperatures and different thicknesses or to join an elastic member with a shape memory alloy.

However, the conventional print head using the shape memory alloy involves a difficulty in shrinking the head dimension, an inferior nozzle compactness to degrade resolution and a demanding job in its fabrication, thereby negatively affecting mass production. Also, the shape memory alloy used therein is embodied by a thick layer having a thickness of more than 50 $\mu$m instead of incorporating with a thin film. Therefore, it dissipates greater electric power during a heating operation and requires longer cooling time to be disadvantageous of resulting in degraded operating frequency and slow printing speed to have no practical use, etc.

SUMMARY OF THE INVENTION

This applicant, in order to solve the above-described problems heretofore, has been filing an application for a print head which injects a recording solution while a pressure of a liquid chamber is varied by vibration induced in accordance with a temperature variation of a thin film shape memory alloy. According to the formerly filed print head, an actuating force of the thin film shape memory alloy is great for decreasing the clogging of a nozzle. Also, the thin film shape memory alloy has so large deforming quantity to allow for fabrication of the print head in small size, heightening the compactness of the nozzle to enhance resolution. In addition, the thin film shape memory alloy can be easily embodied by using a semiconductor thin film fabricating process and substrate etching process to enhance mass productivity.

The present invention relates to an improvement of the formerly filed print head. Accordingly, it is an object of the present invention to provide an apparatus and method for injecting a recording solution of a print head, wherein a second thin film capable of regulating the deforming quantity and buckling force of a vibration plate is coupled to a thin film shape memory alloy for increasing the buckling force when the thin film shape memory alloy is buckled to its bending-deformed state during being cooled, thereby shortening the time required for buckling the vibration plate to the bending-deformed state after the recording solution is injected, increasing the operating frequency to improve printing performance and reinforcing a rigidity of the vibration plate to reduce a concern about damage resulting from an external shock.

To achieve the above object of the present invention, there is provided an apparatus for injecting a recording solution of a print head, which includes vibration plates having a thin film shape memory alloy of a shape memory alloy phase-transformed in accordance with a temperature variation and at least one second thin film coupled to the thin film shape memory alloy for regulating the phase transforming quantity. Also, an electric power supply section incites the temperature variation of the thin film shape memory alloy, and a passage plate installed over the thin film shape memory alloy is formed with liquid chambers for retaining the recording solution and a feed path in one sides of wall planes surrounding the liquid chambers for introducing the recording solution. In addition, a nozzle plate is installed over the passage plate and formed with nozzles having dimensions smaller than those of the liquid chambers of the passage plate for enabling the recording solution to be injected in the form of droplet when the phase of the vibration plate is transformed.

The present invention is contrived for solving the drawbacks of the conventional systems of using the piezo-electric device and air expansion by heating and of the conventional system of using the shape memory alloy. Thus, the vibration plate formed by the thin film shape memory alloy and the second thin film having the residual compressive stress is formed onto a substrate by using a semiconductor thin film fabricating process, and the substrate is partially etched to provide a space portion for allowing the vibration plate to vibrate. In turn, the droplet is formed by the vibration of the vibration plate.

In this injecting apparatus, the thin film shape memory alloy is formed onto the substrate by being deposited via a sputtering method and then being annealed. Therefore, the flat form can be obtained in the austenite state. Also, the second thin film is constructed to be coupled with the thin film shape memory alloy, using the semiconductor thin film fabricating process. The deposited second thin film may be provided with the residual compressive stress of which magnitude may be varied in accordance with the deposition method, deposition conditions or substance. Once the substrate is partially etched to form the space portion, the vibration plate consisting of the thin film shape memory alloy and second thin film is bending-deformed by the residual compressive stress of the second thin film. When the thin film shape memory alloy is heated, the vibration plate is to be changed into the state of being flattened by the action of the shape memory alloy. At this time, the capacity of the liquid chamber is decreased to inject the recording solution. During the cooling operation, the bending deformation occurs due to the residual compressive stress of the second thin film. At this time, the recording solution is refilled. These steps are repeated to successively carry out the injection of the recording solution.

According to the present invention, the simplified vibration plate formed by the thin film shape memory alloy and second thin film is embodied via the semiconductor thin film fabricating process and substrate etching process. By doing so, the residual compressive stress of the second thin film provided via the semiconductor thin film fabricating process is utilized to easily embody the displacement of the vibration plate required for injecting the recording solution, so that the mass production is significantly increased. In addition, the magnitude of the residual stress of the second thin film is changed to easily regulate the deforming quantity and to increase the displacement quantity, making it possible to reduce the dimensions of the vibration plate. Consequently, the head can be formed to be small in size and the compactness of the nozzles is heightened to attain the high resolution. Besides, the second thin film controls the bending-deforming direction to realize the apparatus for injecting the recording solution of the structure having multiple directional characteristics.

The thin film shape memory alloy is utilized in the present invention to greatly cut down the power dissipation when performing the heating operation and to quicken the cooling time. Additionally, when the thin film shape memory alloy is buckled to the bending-deformed state by the residual compressive stress of the second thin film after injecting the recording solution, a distinctively forceful buckling force is exerted while involving no residual vibration, thereby being capable of performing stabilized injection of the recording solution with the consequence of increasing the operating frequency, i.e., enhancing the printing speed.

BRIEF DESCRIPTION OF THE DRAWINGS

The above objects and other advantages of the present invention will become more apparent by describing in detail preferred embodiments thereof with reference to the attached drawings in which:

FIG. 6 is side section views showing the injecting apparatus according to one embodiment of the present invention, in which

FIG. 12 is sectional views showing the injecting apparatus according to another embodiment of the present invention, in which

FIGS. 13A to 13D are sectional views showing the injecting apparatus according to still another embodiment of the present invention.

DETAILED DESCRIPTION OF THE PREFERRED EMBODIMENTS

Figure 1:
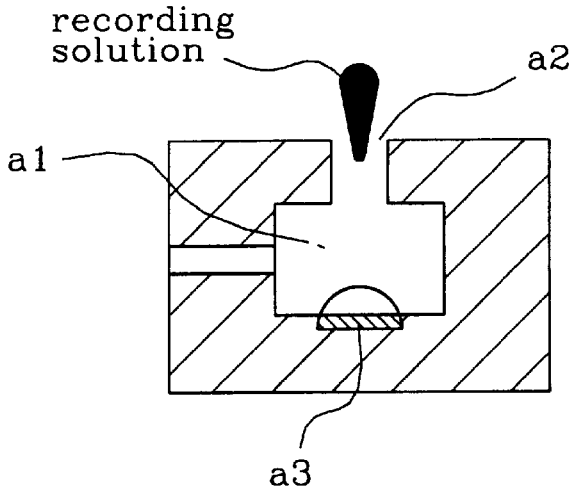
FIG. 1 (PRIOR ART)
FIG. 1 is a sectional view showing a conventional thermal-type injecting apparatus.
Figure 2:
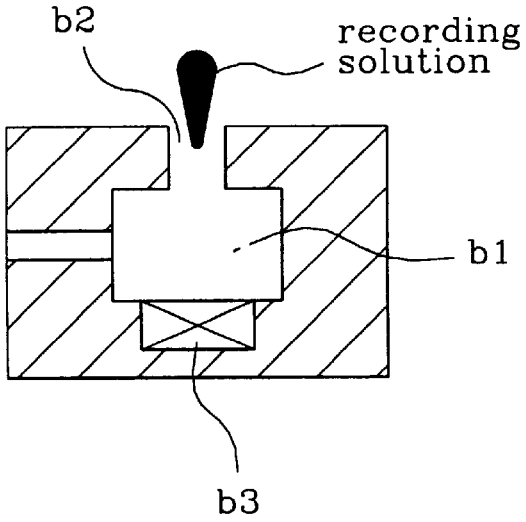
FIG. 2 (PRIOR ART)
FIG. 2 is a sectional view showing a conventional piezo-electric type injecting apparatus.
Figure 3:
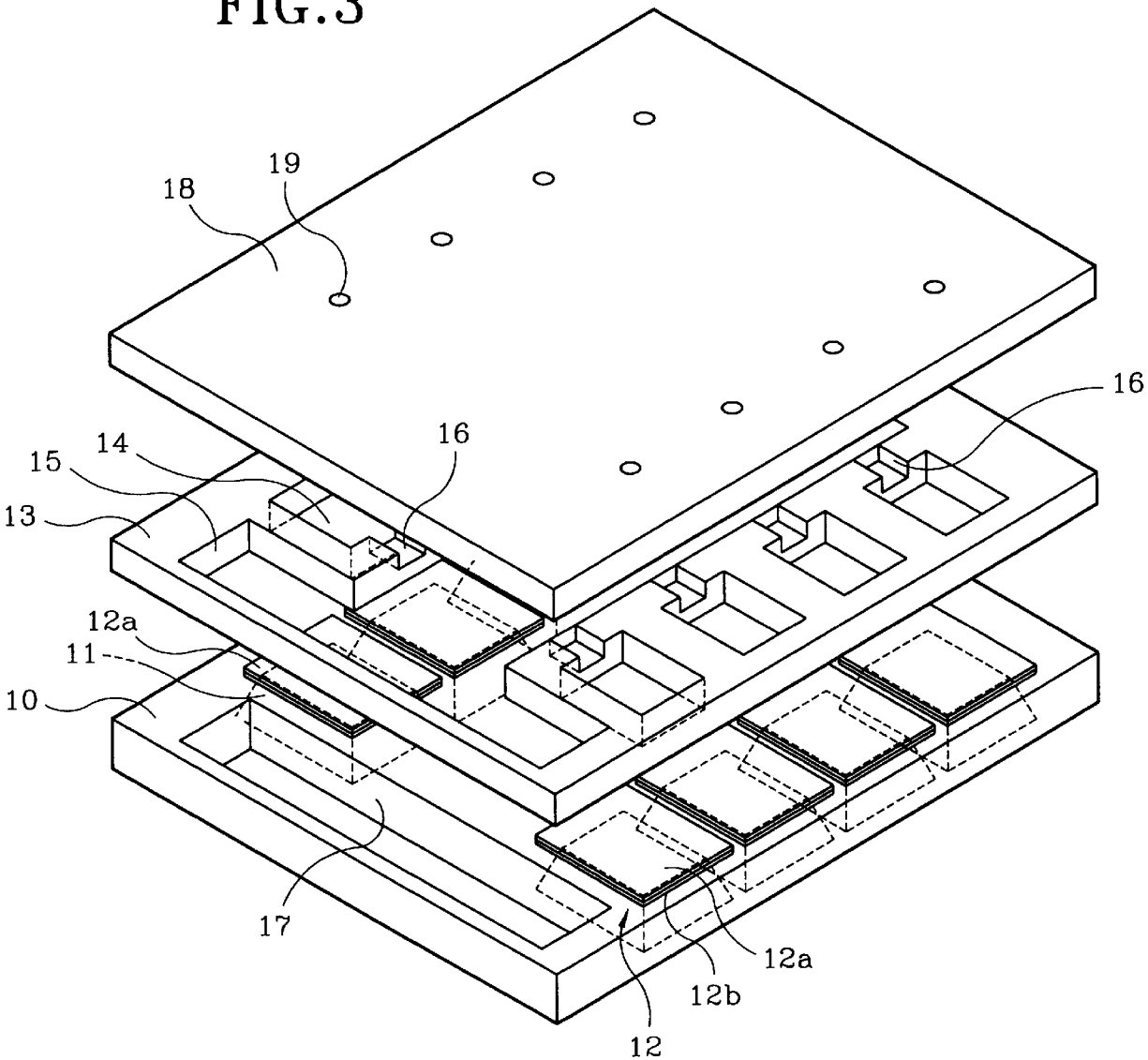
FIG. 3 is an exploded perspective view showing an injecting apparatus according to one embodiment of the present invention.
Figure 4:
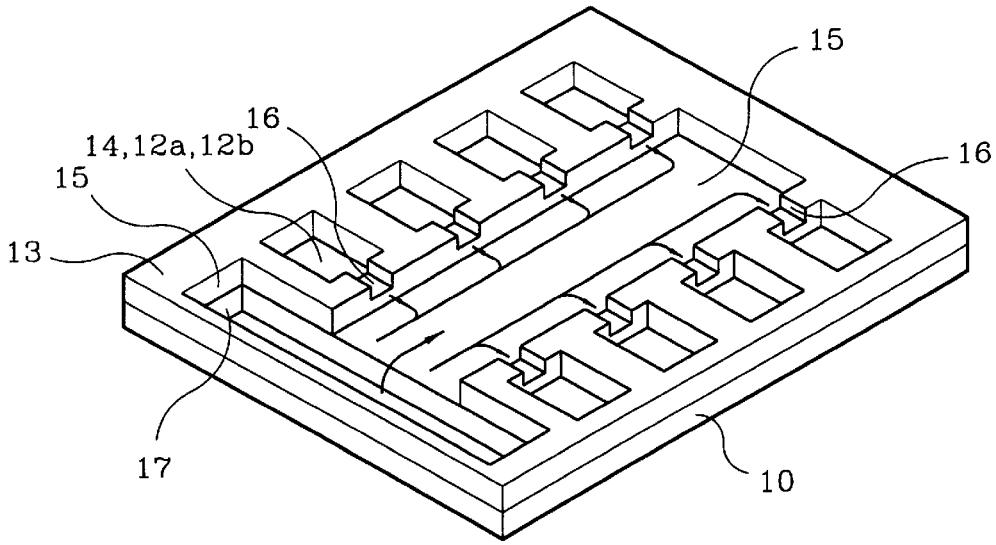
FIG. 4 is a perspective view showing the flow of a recording solution according to one embodiment of the present invention.

FIG. 3 is an exploded perspective view showing an injecting apparatus according to one embodiment of the present invention, and FIG. 4 is a perspective view showing the flow of a recording solution according to one embodiment of the present invention. The injecting apparatus according to the present invention is constructed such that a plurality of nozzles 19 for injecting a recording solution 20 are arranged in both rows and columns to heighten resolution, and vibration plates 12 for substantially injecting recording solution 20 correspond to respective nozzles 19 one by one. In more detail, a plurality of space portions 11 are provided to the front and rear sides of a substrate 10 while penetrating therethrough in the up and down direction, and plurality of vibration plates 12 are joined to the upper portion of substrate 10 for covering respective space portions 11. Vibration plate 12 is vibrated in accordance with a temperature and injects recording solution 20 by an actuating force produced at this time. Vibration plate 12 is formed by a thin film shape memory alloy 12*a* and a second thin film 12*b*. Especially, second thin film 12*b* is formed of a substance capable of regulating the deforming quantity and buckling force of vibration plate 12, which increases the bending deformation speed (buckling force) to heighten the operating frequency.

A passage plate 13 covers the upper portion of substrate 10, which is formed with liquid chambers 14 for retaining recording solution 20 at the direct upper portions of corresponding vibration plates 12. Also, a feed path 15 for flowing recording solution 20 therethrough is provided into the center of passage plate 13 in such a manner that feed path 15 is mutually communicated with corresponding liquid chamber 14 via flow passages 16. A pouring entrance 17 communicated with feed path 15 at one side of passage plate 13 is provided to one side of substrate 10 for supplying recording solution 20 toward feed path 15.

A nozzle plate 18 is joined to the upper portion of passage plate 13, which is formed with plurality of nozzles 19 corresponding to respective liquid chambers 14 formed into passage plate 13. Respective nozzles 19 correspond to vibration plates 12 exposed to corresponding liquid chamber sides. Thus, while the pressure of corresponding liquid chambers 14 is changed when vibration plates 12 are vibrated, recording solution 20 is injected through respective nozzles 19 in the state of droplet onto a sheet of printing paper.

Figure 5A:
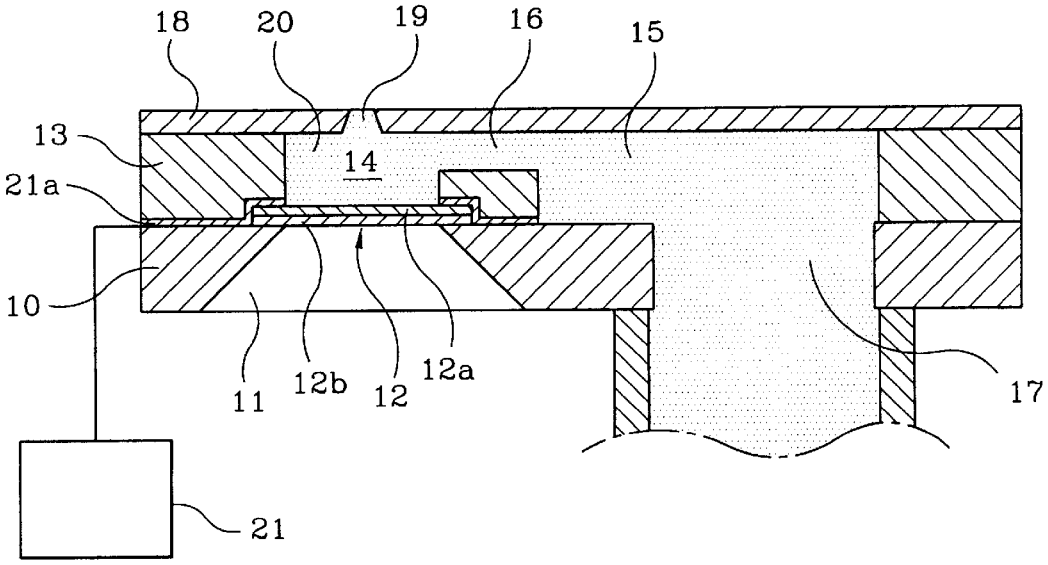
FIGS. 5A, 5B and 5C are front section views showing the injecting apparatus according to one embodiment of the present invention.

The phase of thin film shape memory alloy 12*a* forming vibration plate 12 is successively transformed in accordance with a temperature variation. During the phase transforming procedure, vibration occurs and recording solution 20 is injected through respective nozzles 19 in the form of droplet. Also, thin film shape memory alloy 12*a* is heated by an electric power supply section 21 as shown in FIG. 5A. That is, once the electric power of electric power supply section 21 is applied to electrodes 21*a* connected to both ends of thin film shape memory alloy 12*a*, thin film shape memory alloy 12*a* generates heat by its own resistance to have the temperature raised and is to be flattened. Unless the electric power is applied to electric power supply section 21, thin film shape memory alloy 12*a* naturally cools down and vibration plate 12 is buckled into the original bulging state by second thin film 12*b*.

Figure 5B:
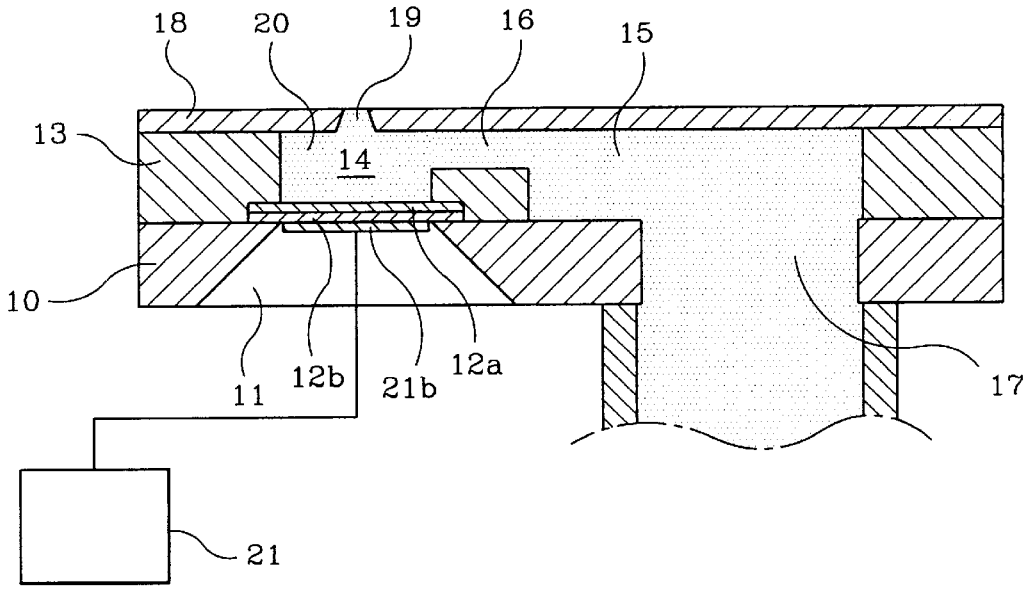
Figure 5C:
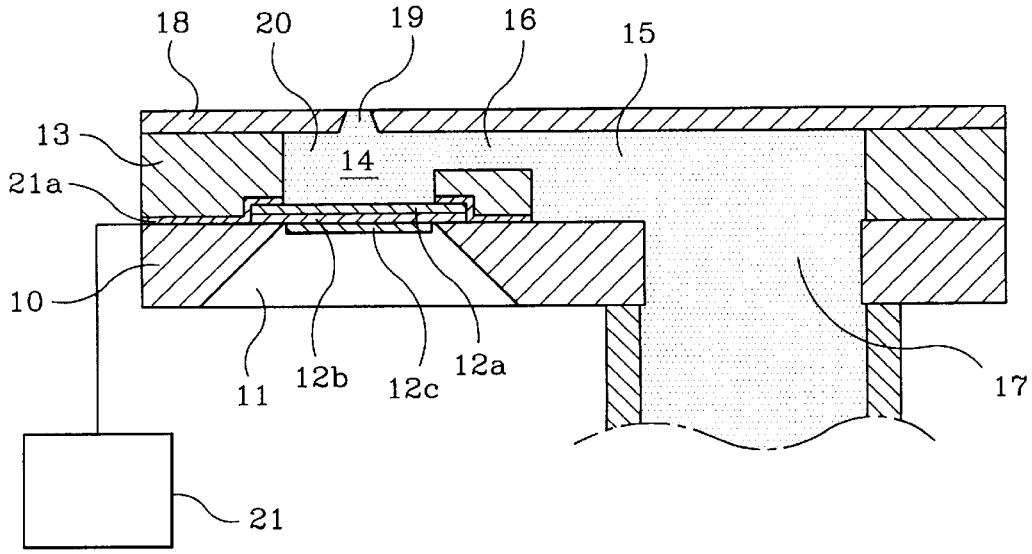

Here, a heater 21*b* heated by the electric power applied from electric power supply section 21 may be attached to one side of second thin film 12*b* as shown in FIG. 5B to heat thin film shape memory alloy 12*a*. In addition, as shown in FIG. 5C, a radiating plate 12*c* may be separately attached to the bottom surface of second thin film 12*b* to speed up the cooling of vibration plate 12. Radiating plate 12*c* which is for quickly cooling down heated vibration plate 12 within a short time period to buckle it increases the operating frequency of vibration plate 12. Such radiating plate 12*c* is formed of nickel (Ni) having a good heat emission property to a thickness of about 0.5 $\mu$m~3 $\mu$m. Also, thin film shape memory alloy 12*a* forming vibration plate 12 is mainly formed of titanium (Ti) and Ni having a thickness of about 0.1 $\mu$m ~5 $\mu$m. Second thin film 12*b* utilizes a substance such as a thermally grown silicon dioxide ($SiO_2$) or polysilicon to have a thickness of about 0.1 $\mu$m~3 $\mu$m.

Figure 6A:
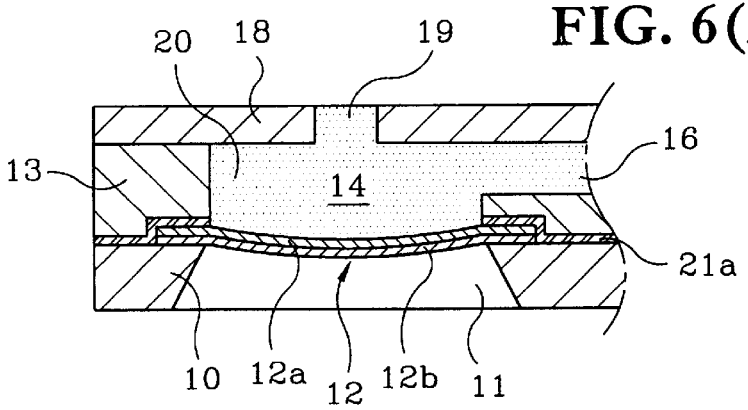
FIGS. 6A to 6C illustrate the states of being before/after the operation.
Figure 6B:
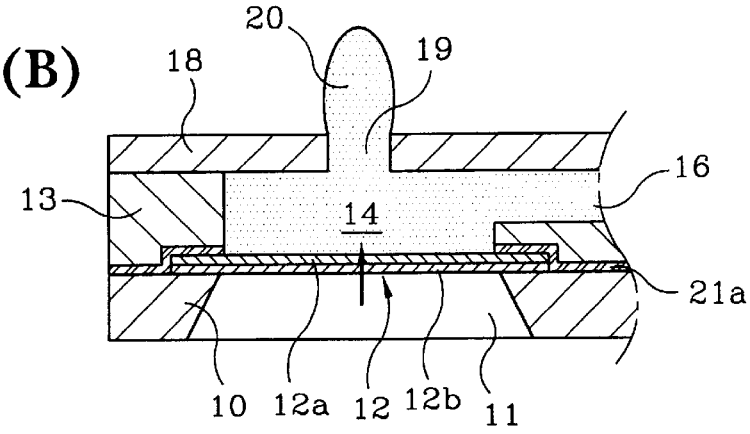
Figure 6C:
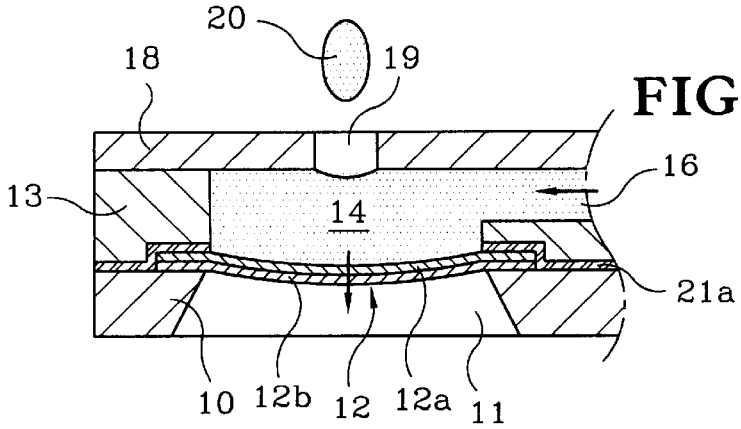
Figure 7:
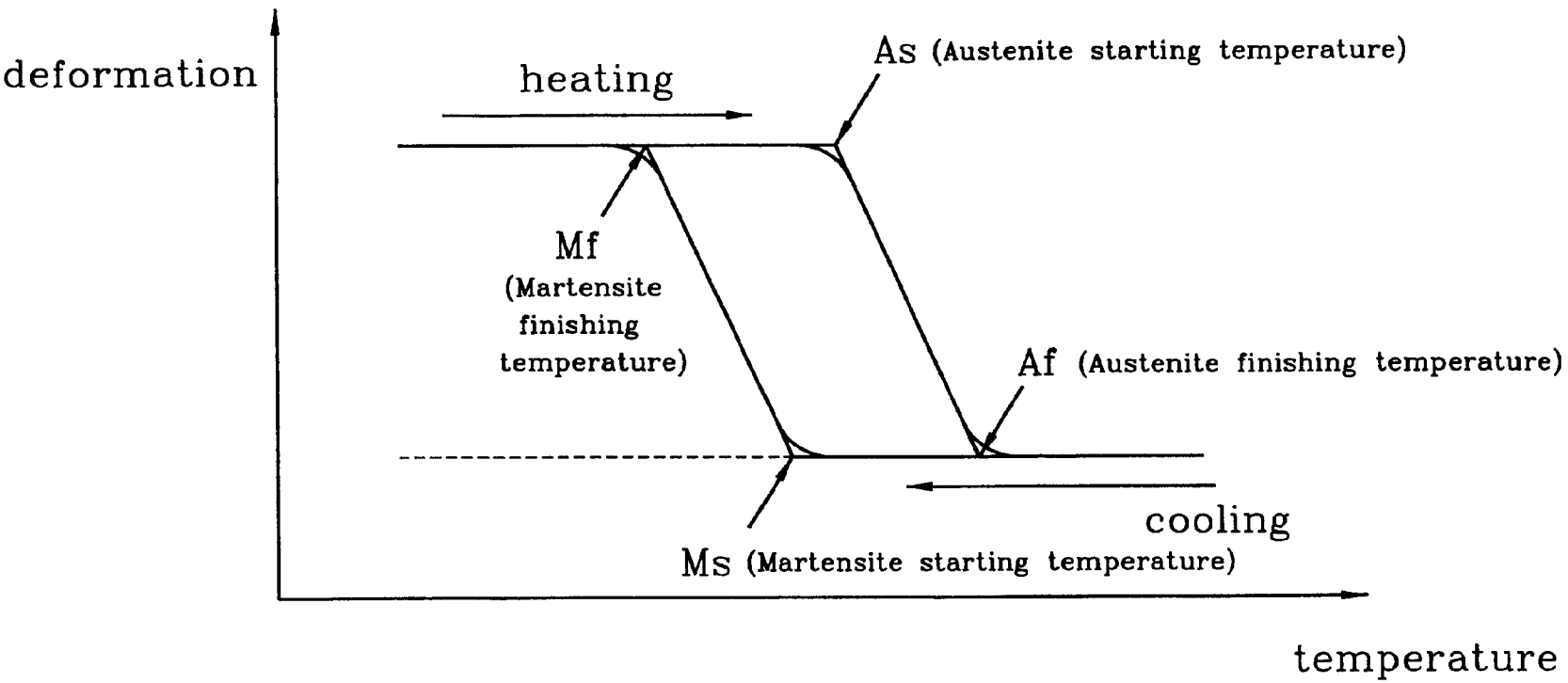
FIG. 7 is a graph representation plotting the phase transformation of a thin film shape memory alloy according to the present invention.
Figure 8A:
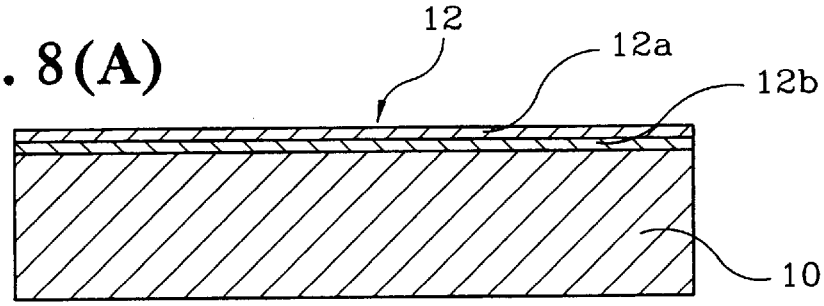
FIG. 8 is views for showing a fabricating process of the vibration plate according to the present invention.
Figure 8B:
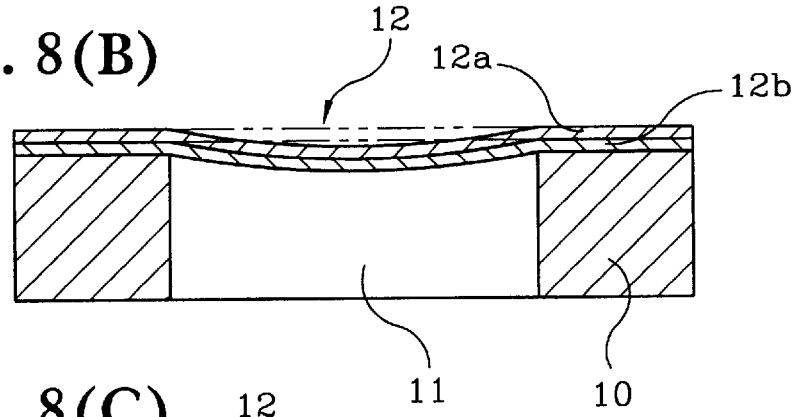
Figure 8C:
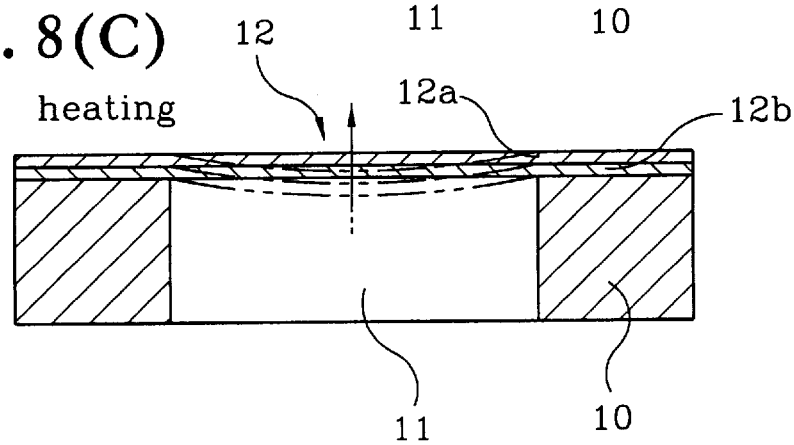
Figure 8D:
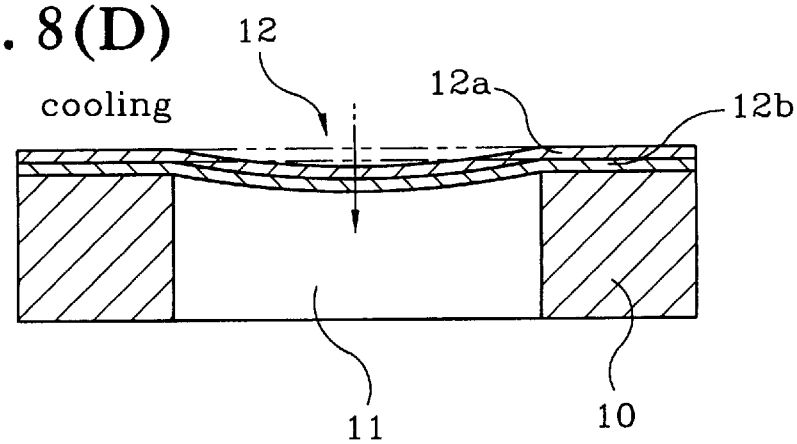

FIGS. 6A, 6B and 6C are side section views showing the injecting apparatus according to one embodiment of the present invention, in which substrate 10 is formed of silicon. When thin film shape memory alloy 12*a* under the initial state of being deformed to bulge to the opposite side of nozzle 19 is heated to be over a preset temperature, vibration plate 12 is to be flattened. At this time, the internal pressure of liquid chamber 14 is increased to be compressed, and, simultaneously, recording solution 20 is injected via nozzle 19.

Once the temperature of thin film shape memory alloy 12*a* is dropped down to be below a preset temperature, vibration plate 12 is buckled to bulge as its original state, and recording solution 20 is introduced into the interior of liquid chamber 14 by the capillary force of recording solution in nozzle and inhaling force while the internal pressure of liquid chamber 14 is gradually lowered. Then, the above-described process is successively repeated to inject the recording solution in the form of droplet. When vibration plate 12 is deformed into the bulging state, the buckling force of vibration plate 12 is intensified by the residual compressive stress of second thin film 12*b* to increase the operating frequency. By enlarging the buckling force of vibration plate 12, second thin film 12*b* can be buckled within a short time period. As the result, the recording solution is rapidly refilled to be instantaneously injected, thereby increasing the operating speed of the print head.

Figure 9:
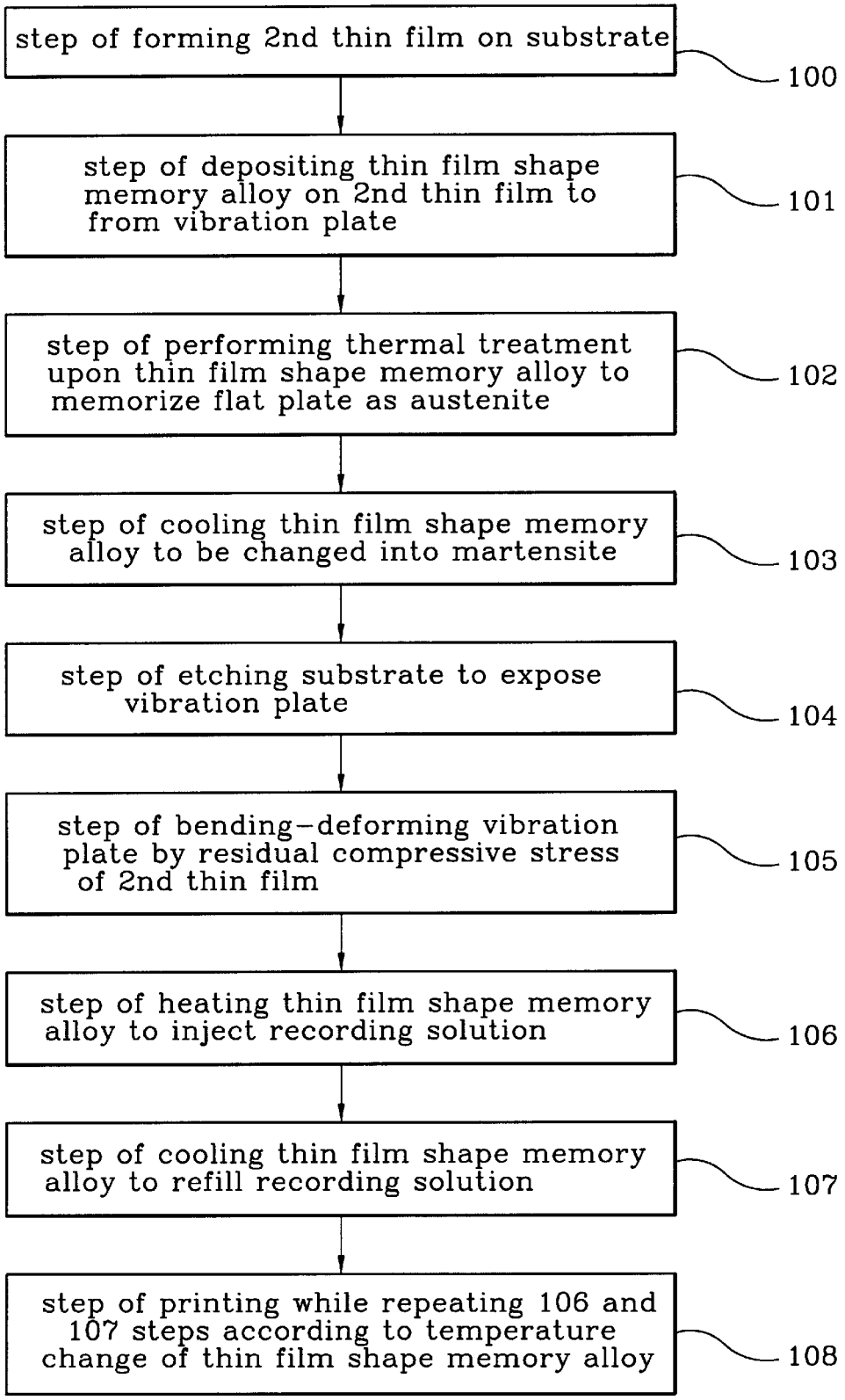
FIG. 9 is a block diagram for showing the fabricating process of the vibration plate according to the present invention.

FIG. 8 is views showing a fabricating process of the vibration plate according to the present invention, and FIG. 9 is a block diagram for showing the fabricating process of the vibration plate according to the present invention, in which a semiconductor fabricating process and a substrate etching process are utilized. Here, a step 100 is performed by forming second thin film 12*b* on substrate 10 composed of a substance such as silicon, glass, metal or polymer via the semiconductor thin film fabricating process to provide a residual compressive stress of a constant magnitude. In step 101 thin film shape memory alloy 12*a* is deposited onto the upper portion of second thin film 12*b* to constitute vibration plate 12. At this time, a sputter-deposition is generally adopted as the depositing method. Then, thin film shape memory alloy 12*a* is annealed at a regular temperature for a given period of time to be crystallized, thereby making the flat plate form memorize as an austenite in step 102. In step 103, thin film shape memory alloy 12*a* is cooled down to be approximately 40° C.~70° C. being a martensite finishing temperature Mf to be changed into the martensite.

In addition, the direct lower portion of vibration plate 12 is subjected to a silicon etching to provide space portion 11 into substrate 10, and vibration plate 12 is externally exposed in step 104. Successively, vibration plate 12 is externally exposed to involve the bending deformation toward lower portion (or upper portion) by the residual compressive stress of second thin film 12*b*, so that the state as shown in FIG. 6A is attained in step 105. The magnitude of the residual compressive stress of second thin film 12*b* can be regulated in accordance with the deposition condition and applied substance during the procedure of being formed by means of the semiconductor fabricating process. Particularly, the bending direction of vibration plate 12 is determined by second thin film 12*b* whether it is formed to the upper side or lower side of thin film shape memory alloy 12*a*.

Thin film shape memory alloy 12*a* maintains the martensite bending-deformed as above. In step 106, once thin film shape memory alloy 12*a* is heated by a preset temperature, i.e., an austenite finishing temperature Af of approximately 500° C.~90° C., thin film shape memory alloy 12*a* is flattened as shown in FIG. 6B to inject recording solution 20. After this, upon cooling of thin film shape memory alloy 12*a,* it is transformed into the martensite to be bending-deformed by the residual compressive stress of second thin film 12*b,* thereby refilling liquid chamber 14 with recording solution 20 in step 107. While the foregoing steps 106 and 107 are repeated in accordance with the change of temperature of thin film shape memory alloy 12*a,* recording solution 20 is injected in the form of droplet to perform the printing operation in step 108.

Thin film shape memory alloy 12*a* according to the present invention is flattened in the austenite when being heated and is bending-deformed in the martensite when being cooled in accordance with the temperature difference. For this fact, as the temperature difference is smaller, the operating frequency of vibration plate 12 becomes increased. Therefore, copper (Cu) may be added into the alloy of Ti and Ni for decreasing the temperature difference. The shape memory alloy using Ti, Ni and Cu decreases the phase-transforming temperature difference to increase the frequency, i.e., the operating frequency, thereby heightening the printing speed.

The possibility of embodying the droplet of the thin film according to the present invention formed as above is interpreted as follows.

Assuming that the diameter of the droplet is 60 $\mu$m produced in case that an energy density generated by thin film shape memory alloy 12*a* is $10\times10^6$ J/m$^3$ in maximum and the dimensions of thin film shape memory alloy 12*a* exposed by space portion 11 is $200\times200\times1$ $\mu$m$^3$, the injectability of the thin film is judged as below:

$$U = U_s + U_K$$

$$U_s = \pi R^2 \gamma$$

$$U_K = \frac{1}{12}\pi\rho R^3 v^2$$

where a reference symbol U denotes the energy required for generating the desired droplet of the recording solution; $U_s$, a surface energy of the recording solution; $U_K$, a kinetic energy of the recording solution; R, a diameter of the droplet; v, velocity of the recording solution; ρ, a density of the recording solution (1000 kg/m$^3$); and γ, a surface tension (0.073 N/m) of the recording solution. Here, providing that the velocity of the desired droplet is 10 m/sec, required energy U can be written as:

$$U=2.06\times10^{-10}+7.07\times10^{-10}=9.13\times10^{-10}\ J$$

Also, the maximum energy generated by thin film shape memory alloy 12*a* is defined by $$W_{max}=W_v\cdot V.$$

That is, $$W_{max}=(10\times10^8)\cdot(200\times200\times1)=4\times10^{-7}\ J$$

When the diameter of the droplet is 100 $\mu$m, required energy U equals $3.85\times10^{-9}$J.

Therefore, since $W_{max}\gg U$, the droplet of desired dimensions can be embodied. In other words, since thin film shape memory alloy 12*a* has the considerably great actuating force, the desired droplet of the recording solution can be easily embodied.

Furthermore, the displacement quantity resulting from the heating time, dissipated energy and residual compressive stress of one embodiment of the present invention can be analyzed as follows. The electric power is applied to thin film shape memory alloy 12*a* to generate the heat by its own resistance and the phase is to be transformed by the heat generated, only that the heating time and dissipated energy until thin film shape memory alloy 12*a* of 25° C. is heated to be the austenite of 70° C. are obtained as below.

Here, a substance of the thin film shape memory alloy is TiNi; a length l of the thin film shape memory alloy is 400 $\mu$m; a density $\rho_s$ of the thin film shape memory alloy is 6450 kg/m$^3$ and quantity of the temperature variation ΔT is 45° C. by 70 minus 25. Also, a specific heat $C_\rho$ is 230 J/Kg° C.; a specific resistance ρ of the thin film shape memory alloy is 80 $\mu$·cm; applied current I is 1.0A; a width w of the thin film shape memory alloy is 300 $\mu$m; and a height t of the thin film shape memory alloy is 1.0 $\mu$m. Accordingly, heating time $t_h$ is obtained by $$t_h = \rho_s \Delta T \frac{C_p (W\cdot t)^2}{\rho\cdot I^2}$$

$$= 7.4\ \mu\text{sec}$$

Thus, since resistance R of the thin film shape memory alloy, i.e., ρ(l/w·t)=1.1 Ω and dissipated electric power $I^2R$ is 1.1 Watt, the energy required for generating the droplet is obtained by:

heating time×dissipated electric power=8.1 $\mu$J

Therefore, the energy required for producing the droplet by injecting recording solution 20 is roughly 8.1 $\mu$J which is decreased to be smaller than the conventional energy dissipation of 20 $\mu$J that has been required for the thermal type Ink-jet system.

Figure 10:
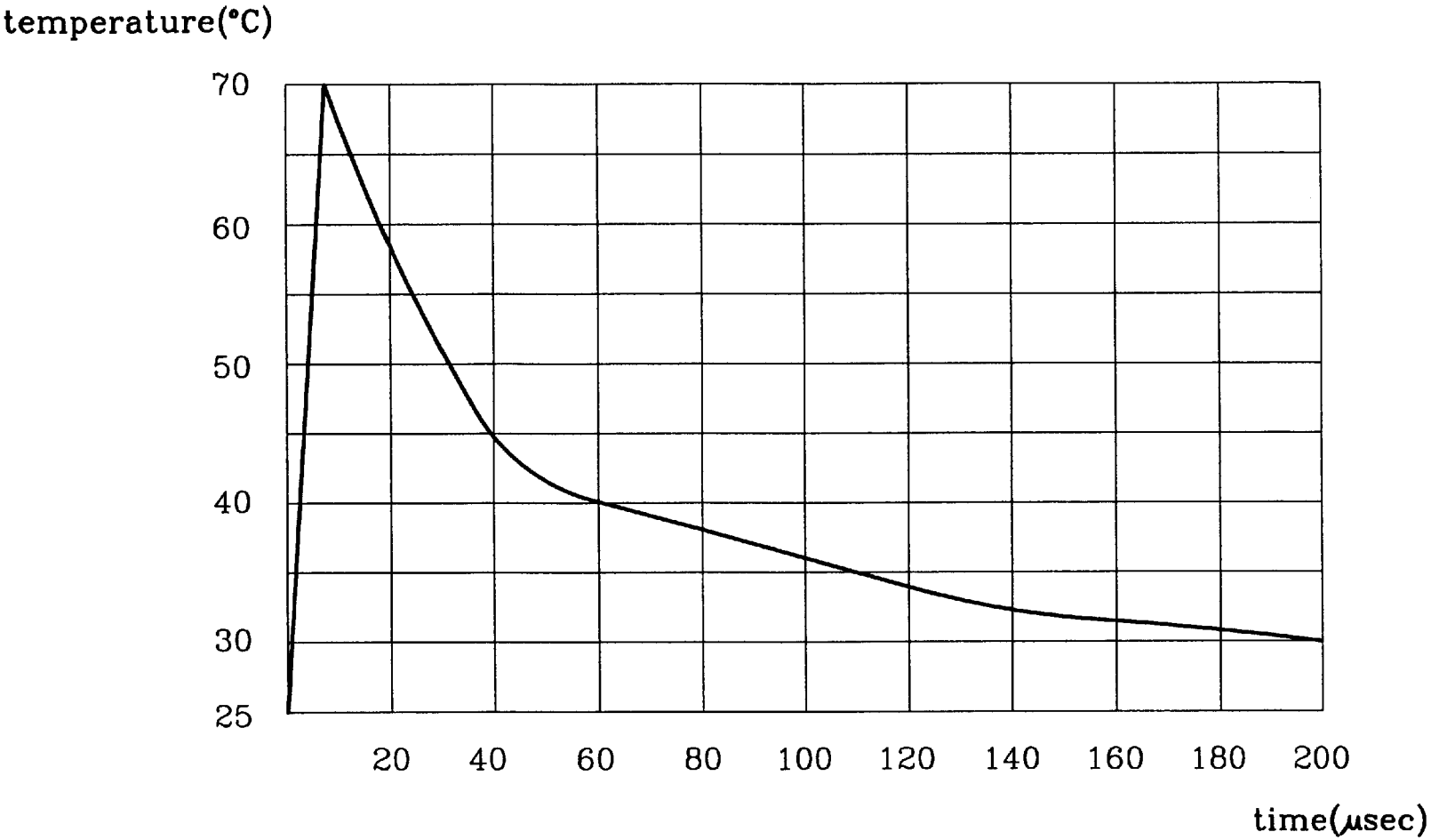
FIG. 10 is a graph representation plotting the heating time and temperature of the thin film according to the present invention.

FIG. 10 is a graph representation plotting the heating time and temperature of the thin film shape memory alloy according to the present invention, in which the material values for performing the experiment are as follows.

Here, the thickness of thin film shape memory alloy 12*a* is 1 $\mu$m and the surrounding temperature is 25° C.

| | Recording solution (water) | Air | Thin film shape memory alloy (TiNi) | Substrate (Si) |
|---|---|---|---|---|
| Density (kg/m$^3$) | 1000 | 1 | 6400 | 2330 |
| Specific heat (J/kg · k) | 4179 | 1000 | 230 | 890 |
| Coefficient of heat transfer | 0.566 | 0.026 | 23 | 124 |

Under the state that the surrounding temperature is 25° C., the time required for heating thin film shape memory alloy 12*a* up to 70° C. to be transited into the austenite to cool down it to 30° C. is roughly 200 $\mu$sec which is approximately 5 kHz when being calculated in terms of the frequency. Accordingly, the operating frequency of the print head is 5 kHz or so. However, since the temperature of completely finishing the deformation (the martensite finishing temperature) is about 45° C., there is no need to wait for being cooled down to 30° C. but it can be heated again in advance to be able to continuously inject recording solution 20. Due to this fact, the operating frequency can be heightened to over 5 kHz. Once the operating frequency is large, the printing speed becomes increased.

Figure 11A:
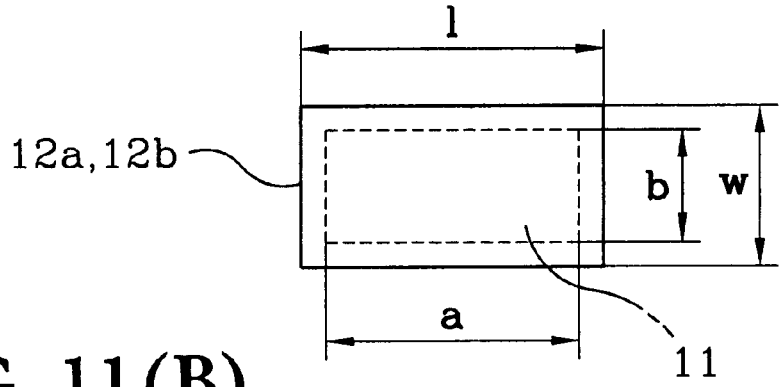
FIG. 11 is a sectional view showing the size of the vibration plate according to the present invention.
Figure 11B:
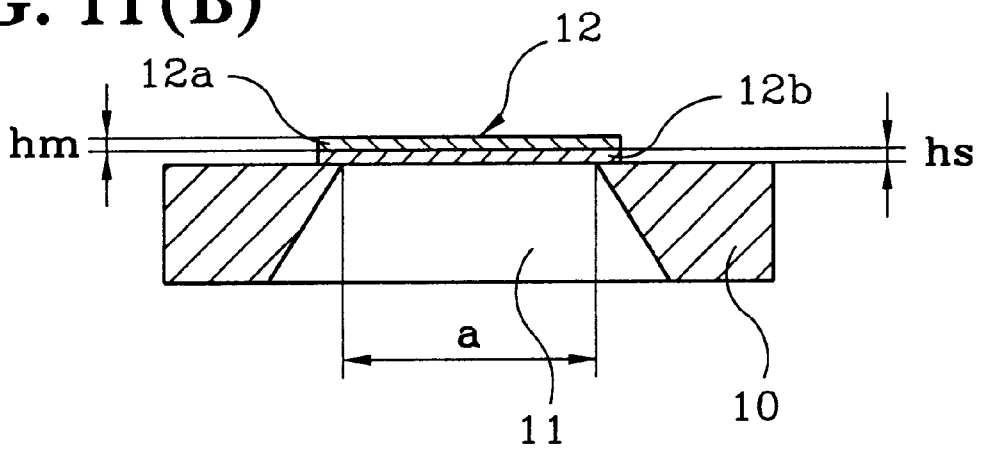

Also, the displacement quantity and buckling force in accordance with the thin film shape memory alloy and its own residual compressive stress can be analyzed as follows with reference to FIG. 11.

Assuming that a=b and a=200 $\mu$m when the substance of the thin film shape memory alloy is TiNi, Youngs modulus $E_m$ of the thin film shape memory alloy is 30GPa, residual compressive stress S present in the thin film shape memory alloy is 30 MPa, Poisson's ratio ν is 0.3, the length of the thin film shape memory alloy exposed to space portion 11 is denoted by a, the thickness of the thin film shape memory alloy is denoted by $h_m$ and the width of the thin film shape memory alloy exposed to space portion 11 is denoted by b, a critical stress $S_{cr}$ of the thin film shape memory alloy is written as:

$$S_{cr} = 4.38\frac{h_m^2}{a^2}\frac{E_m}{1-\nu^2}, \text{ thus} \quad (1)$$
$$S_{cr} = 3.6 \text{ MPa}$$

and the central displacement $\delta_m$ of the thin film shape memory alloy is defined such that:

$$\delta_m = 2.298 h_m\sqrt{\left(\frac{S}{S_{cr}}-1\right)} \quad \text{and} \quad (2)$$
$$\delta_s = 6.2\,\mu\text{m}$$

Maximum energy $W_{max}$ generated by the thin film shape memory alloy is obtained as $W_{max}=W_v \cdot V$ (where $W_v$ denotes the energy J/m$^3$ exercisable per unit volume of the thin film shape memory alloy, and V denotes the volume of the thin film shape memory alloy. That is, $$W_{max}=(10\times10^6)\cdot(200\times200\times1)=4\times10^{-7}\,J$$

The total energy $U_m$ generated by the buckling of the thin film shape memory alloy when being cooled is written as:

$$U_m = \frac{2500 D_m h_m^2}{33 a^2}\left(\frac{S}{S_{cr}}-1\right)^2 \quad \text{where}$$
$$D_m = \frac{E_m h_m^3}{12(1-\nu^2)} \quad \text{thus}$$
$$U_m = 2.8\times10^{-10}\,J$$

The total energy generated when the thin film shape memory alloy is buckled after injecting recording solution 20 is changed into buckling force P which incites the bending-deformation of the thin film shape memory alloy. Buckling force P is written as below.

$$U_m=P\cdot\Delta V$$

Since ΔV (volume variation)=$(\delta_s \cdot a^2)/4=6.2\times10^{-14}$m$^3$, buckling force P is 4.5 KPa.

Supposing that half the total volume variation effected by the buckling of the thin film shape memory alloy is injected, the droplet of 39 $\mu$m is formed.

The displacement quantity of the thin film shape memory alloy is represented as the following table, in which the corresponding unit is $\mu$m.

| | | | |
|---|---|---|---|
| a × b × $h_m$ | 300 × 120 × 0.5 | 400 × 120 × 0.5 | 600 × 120 × 0.5 |
| Displacement quantity | 4.5 | 4.5 | 4 |
| a × b × $h_m$ | 300 × 150 × 0.5 | 400 × 150 × 0.5 | 600 × 150 × 0.5 |
| Displacement quantity | 5.7 | 5.7 | 5.7 |
| a × b × $h_m$ | 300 × 200 × 0.5 | 400 × 200 × 0.5 | 600 × 200 × 0.5 |
| Displacement quantity | 7.4 | 7.6 | 7.6 |
| a × b × $h_m$ | 300 × 120 × 1.0 | 400 × 120 × 1.0 | 600 × 150 × 1.0 |
| Displacement quantity | 4.0 | 4.0 | 4.0 |
| a × b × $h_m$ | 300 × 150 × 1.0 | 400 × 150 × 1.0 | 600 × 150 × 1.0 |
| Displacement quantity | 5.3 | 5.3 | 5.3 |
| a × b × $h_m$ | 300 × 200 × 1.0 | 400 × 200 × 1.0 | 600 × 200 × 1.0 |
| Displacement quantity | 7.1 | 7.4 | 7.4 |
| a × b × $h_m$ | 300 × 120 × 1.5 | 400 × 120 × 1.5 | 600 × 120 × 1.5 |
| Displacement quantity | 3.1 | 3.1 | 3.1 |
| a × b × $h_m$ | 300 × 150 × 1.5 | 400 × 150 × 1.5 | 600 × 150 × 1.5 |
| Displacement quantity | 4.6 | 4.6 | 4.6 |
| a × b × $h_m$ | 300 × 200 × 1.5 | 400 × 200 × 1.5 | 600 × 200 × 1.5 |
| Displacement quantity | 6.7 | 6.9 | 6.9 |

Additionally, if thin film shape memory alloy 12*a* forming vibration plate 12 has no residual compressive stress, the displacement quantity and buckling force resulting from the residual compressive stress of second thin film 12*b* can be obtained as below.

Assuming that a=b and a=200 $\mu$m when the substance of the thin film shape memory alloy is TiNi, the substance of the second thin film is thermally-grown $SiO_2$, Youngs modulus $E_m$ of the thin film shape memory alloy is 30 GPa, Youngs modulus $E_s$ of the second thin film is 70 GPa, residual compressive stress S exerting upon the second thin film is 300 MPa, Poisson's ratio ν is 0.3, the length of vibration plate 12 exposed to space portion 11 is denoted by a, the width of vibration plate 12 exposed to space portion 11 is denoted by b, the thickness of the thin film shape memory alloy is denoted by $h_m$ which is 1 $\mu$m and the thickness of the second thin film is denoted by $h_s$ which is 1 $\mu$m, a critical stress $S_{cr}$ of the second thin film is written as:

$$S_{cr} = 4.38\frac{h^2}{a^2}\frac{E_s}{1-\nu^2}, \text{ thus} \quad (1)$$
$$S_{cr} = 8.4 \text{ MPa}$$

and the central displacement $\delta_s$ of the second thin film without being joined with the thin film shape memory alloy is defined such that:

$$\delta_s = 2.298 h\sqrt{\left(\frac{S}{S_{cr}}-1\right)} \quad \text{and} \quad (2)$$
$$\delta_s = 13.5\,\mu\text{m}$$

Also, the bending energy $U_b$ produced by the residual compressive stress of the second thin film is obtained as:

$$U_b = \frac{\pi^4 \delta_s^2 D_s}{a^2} \quad \text{where}$$

$$D_s = \frac{E_s h_s^3}{12(1-\nu^2)} \quad \text{thus}$$

$$U_s = 2.9 \times 10^{-9} J$$

The bending energy $U_b$ of the second thin film is stored as the bending energy of vibration plate 12 consisting of the thin film shape memory alloy and second thin film. That is, $$U_b = \frac{\pi^4 \delta^2 D_s}{a^2} + \frac{\pi^4 \delta^2 D_m}{a^2},$$

$$D_s = 6.5 \times 10^{-9} N/m \text{ and}$$

$$D_m = 2.7 \times 10^{-9} N/m$$

When displacement quantity δ of vibration plate 12 is obtained by using the above equations, $$\delta = 11.4\ \mu m$$

The energy dissipated by the second thin film while the recording solution is injected by heating the thin film shape memory alloy corresponds to the bending energy generated by the residual compressive stress of the second thin film.

Therefore, bending energy $U_s$ equals $2.9 \times 10^{-9}$ J

Maximum energy $W_{max}$ generated by the thin film shape memory alloy is obtained as $W_{max} = W_v \cdot V$ (where $W_v$ denotes the energy J/m$^3$ exercisable per unit volume of the thin film shape memory alloy, and V denotes the volume of the thin film shape memory alloy. That is, $$W_{max} = (10 \times 10^6) \cdot (200 \times 200 \times 1) = 4 \times 10^{-7} J$$

The energy ratio $U_s/W_{max}$ consumed by the second thin film with respect to the maximum energy capable of being exerted by thin film shape memory alloy 12*a* is 0.73%. For this fact, the energy loss influenced by the second thin film when injecting the recording solution is negligible.

The total energy $U_s$ generated when the second thin film is buckled is $$_s = \frac{2500 D_s h_s^2}{33 a^2}\left(\frac{S}{S_{cr}} - 1\right)^2 = 1.5 \times 10^{-8}$$

The total energy $U_s$ generated when the second thin film is buckled after injecting recording solution 20 is changed into buckling force P of vibration plate 12. Buckling force P is written as:

$$U_s = P \cdot \Delta V$$

Since ΔV (volume variation)=$(\delta_s \cdot a^2)/4 = 1.4 \times 10^{-13}$ m$^3$, buckling force P is 107.1 KPa.

Supposing that half the total volume variation effected by the deformation of vibration plate 12 is injected, the diameter of the droplet is 51 μm.

In comparing that consisting of only the thin film shape memory alloy with the vibration plate consisting of the thin film shape memory alloy and second thin film, the displacement quantity is increased as many as roughly twice by 11.4 μm from 6.2 μm and the buckling force is increased as many as roughly 20 times or more by 107.1 KPa from 4.5 KPa. Therefore, by using the second thin film, the required displacement quantity can be easily obtained while the buckling force is increased.

The displacement quantity of vibration plate 12 consisting of the thin film shape memory alloy and second thin film is represented as the following table, in which the corresponding unit is μm.

| | | | |
|---|---|---|---|
| a × b × $h_m$ | 300 × 120 × 0.5 | 400 × 120 × 0.5 | 600 × 120 × 0.5 |
| Displacement quantity | 9.1 | 9.1 | 9.1 |
| a × b × $h_m$ | 300 × 150 × 0.5 | 400 × 150 × 0.5 | 600 × 150 × 0.5 |
| Displacement quantity | 11.4 | 11.5 | 11.5 |
| a × b × $h_m$ | 300 × 200 × 0.5 | 400 × 200 × 0.5 | 600 × 200 × 0.5 |
| Displacement quantity | 15.0 | 15.4 | 15.4 |
| a × b × $h_m$ | 300 × 120 × 1.0 | 400 × 120 × 1.0 | 600 × 120 × 1.0 |
| Displacement quantity | 7.8 | 7.8 | 7.8 |
| a × b × $h_m$ | 300 × 150 × 1.0 | 400 × 150 × 1.0 | 600 × 150 × 1.0 |
| Displacement quantity | 9.8 | 9.8 | 9.8 |
| a × b × $h_m$ | 300 × 200 × 1.0 | 400 × 200 × 1.0 | 600 × 200 × 1.0 |
| Displacement quantity | 12.9 | 13.2 | 13.3 |
| a × b × $h_m$ | 300 × 120 × 1.5 | 400 × 120 × 1.5 | 600 × 120 × 1.5 |
| Displacement quantity | 6.0 | 6.0 | 6.0 |
| a × b × $h_m$ | 300 × 150 × 1.5 | 400 × 150 × 1.5 | 600 × 150 × 1.5 |
| Displacement quantity | 7.5 | 7.5 | 7.5 |
| a × b × $h_m$ | 300 × 200 × 1.5 | 400 × 200 × 1.5 | 600 × 200 × 1.5 |
| Displacement quantity | 9.8 | 10.1 | 10.1 |

Figure 12A:
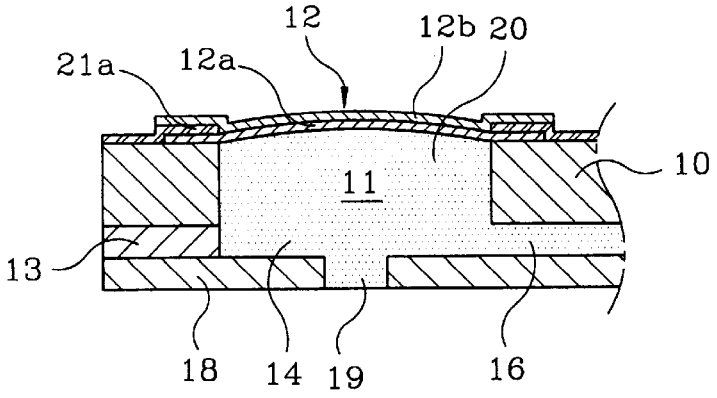
FIGS. 12A to 12C illustrate the states of being before/after the operation.
Figure 12B:
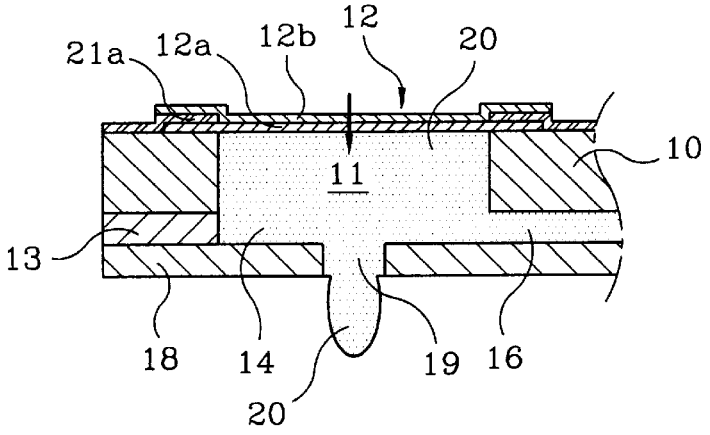
Figure 12C:
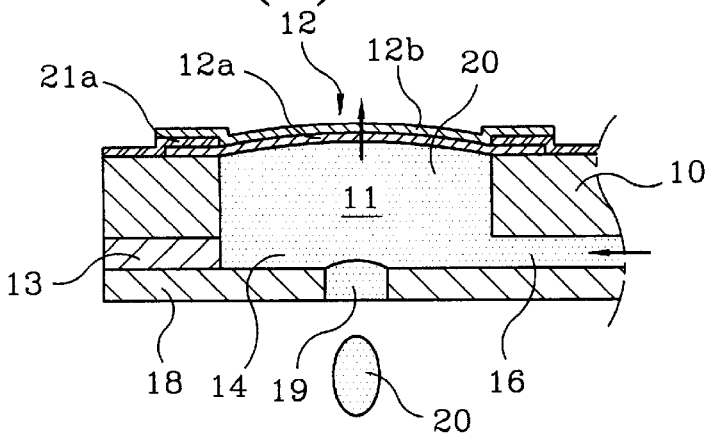

FIGS. 12A to 12C are sectional views showing the injecting apparatus according to another embodiment of the present invention, in which like parts of FIG. 3 are designated by the same reference numerals for description. The another embodiment of the present invention is provided with a passage plate 13 and a nozzle plate 18 to the lower portion of a substrate 10, which are illustrated by taking away any one thin film coupled. A space portion 11 is provided into substrate 10 while penetrating therethrough in the up and down direction, and a vibration plate 12 is joined to the upper portion of substrate 10 for covering space portion 11. Vibration plate 12 is vibrated in accordance with the temperature variation of a thin film shape memory alloy 12*a,* and a recording solution 20 is injected by the actuating force produced at this time. Also, a second thin film 12*b* forming vibration plate 12 increases the bending deformation speed (buckling force) of vibration plate 12, thereby heightening the operating frequency.

Passage plate 13 covers the lower portion of substrate 10, which is formed with a liquid chamber 14 for retaining recording solution 20 by corresponding to space portion 11. Also, nozzle plate 18 joined to the lower portion of passage plate 13 is provided with a nozzle 19 corresponding to liquid chamber 14 formed into passage plate 13. Nozzle 19 corresponds to vibration plate 12 exposed toward liquid chamber 14. Thus, while the pressure of liquid chamber 14 is changed when vibration plate 12 is deformed, recording solution 20 is injected onto a sheet of paper in the form of droplet via nozzle 19.

In the another embodiment of the present invention constructed as above, after thin film shape memory alloy 12*a* is formed on the upper portion of substrate 10, second thin film 12*b* is deposited onto the upper portion of thin film shape memory alloy 12*a*. Then, when space portion 11 is formed into the lower portion of substrate 10, vibration plate 12 is bending-deformed by the residual compressive stress of second thin film 12*b*. Once thin film shape memory alloy 12*a* is heated under the state of being bending-deformed as described above, vibration plate 12 is deformed in the state of the flat plate and is bending-deformed into the initial state when being cooled thereafter. Besides, the buckling force is intensified by the residual compressive stress of second thin film 12*b* during the process of bending-deforming vibration plate 12 to increase the operating frequency.

FIGS. 13A to 13D are sectional views showing the injecting apparatus according to still another embodiment of the present invention, in which the parts identical to those of the above embodiments will be designated by the same reference numerals. Here, a vibration plate 12 is formed to the lower portion of substrate 10, and a passage plate 13 and a nozzle plate 18 are respectively formed to the upper portion of substrate 10. In other words, vibration plate 12 protrudes to the inside of a space portion 11 under the initial state that a thin film shape memory alloy 12*a* is not heated, which is then flattened when being heated. Accordingly, vibration plate 12 is flattened when being heated to refill the inside of liquid chamber 14 with recording solution 20, and is bending-deformed when being cooled to increase the internal pressure of liquid chamber 14, so that recording solution 20 is injected.

Figure 14A:
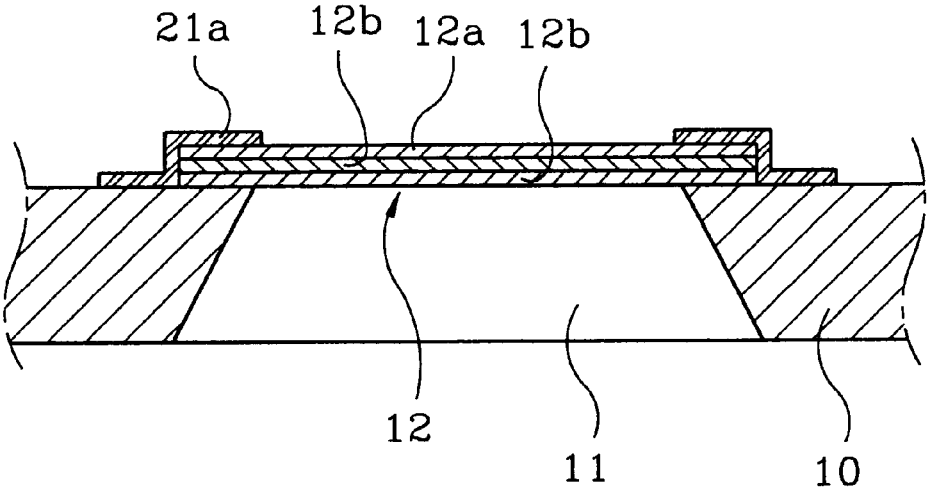
FIGS. 14A and 14B are sectional views showing the injecting apparatus according to yet another embodiment of the present invention.
Figure 14B:
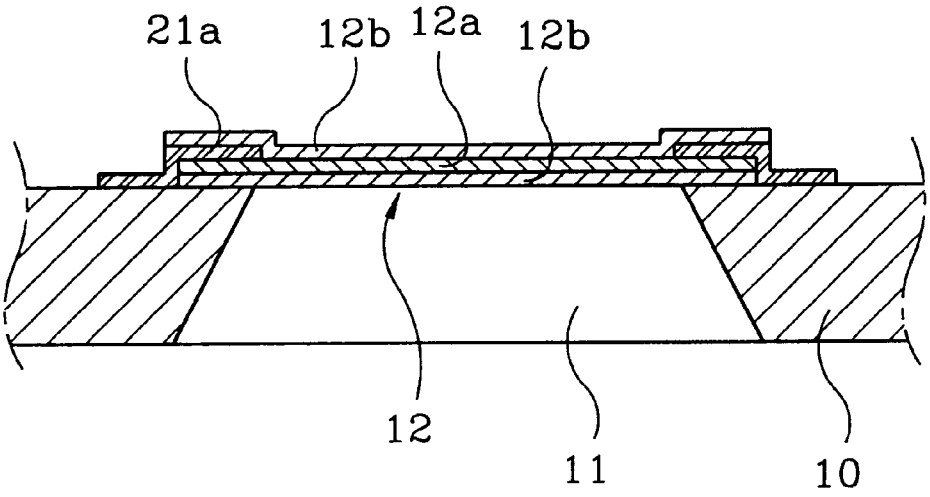

FIGS. 14A and 14B are sectional views showing yet another embodiment of the present invention, in which the parts identical to those of the above embodiment of the present invention will be designated by the same reference numerals for description. Yet another embodiment of the present invention employs a plurality of second thin films 12*b* which may be formed of substances of different kinds. FIG. 14A shows a state that two second thin films 12*b* are formed onto the bottom portion of thin film shape memory alloy 12*a,* and FIG. 14B shows a state that second thin films 12*b* are respectively formed to the upper and lower portions of thin film shape memory alloy 12*a*. By this construction as above, the actuating force of vibration plate 12 can be further intensified, and the required displacement quantity can be more easily embodied. Furthermore, the durability of vibration plate 12 is increased to secure reliability.

In the injecting apparatus according to the present invention as described above, the recording solution is injected by the vibration of the vibration plate in accordance with the temperature variation of the thin film shape memory alloy. Also, the second thin film having the residual compressive stress is coupled to strengthen the buckling force by the residual compressive stress when the vibration plate is buckled into the initial state (bending-deformed state) upon being cooled, thereby increasing the operating frequency. In addition, the vibration plate has the great displacement quantity to make it possible to shrink respective space portions formed in the substrate and respective liquid chambers formed in the passage plate. Thus, the print head is decreased in overall size and is fabricated in small size, so that the compactness of the nozzles is heightened to be favorable to the attainment of high resolution.

Furthermore, the hardness of the vibration plate is heightened by the second thin film to involve less concern about damage resulting from an external shock. Also, since the actuating force is so large to increase the force of pushing out the recording solution, the clogging of the nozzle is decreased to enhance reliability. Moreover, the dimensions of the droplet of the recording solution can be sufficiently shrunken to be advantageous in attaining high picture quality. Additionally, the driving voltage is below 10 volts to facilitate the designing and fabricating of the driving circuit, and the vibration plate is easily embodied by using the typical semiconductor process and etching process to be effective in enhancing the mass productivity and simplifying the structure thereof.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. An apparatus for injecting recording solution of a print head, comprising:

vibration plates having a thin film shape memory alloy of a shape memory alloy phase-transformed in accordance with a temperature variation and at least one second thin film coupled to said film shape memory alloy for regulating the phase transforming quantity;

an electric power supply section for inciting said temperature variation of said thin film shape memory alloy;

a passage plate installed over said thin film shape memory alloy, and being formed with liquid chambers for retaining said recording solution and formed with a feed path in at least one side of at least one wall plane surrounding each of said liquid chambers for introducing said recording solution;

a nozzle plate installed over said passage plate and formed with nozzles having dimensions smaller than those of said liquid chambers of said passage plate for enabling said recording solution to be injected in the form of droplet when said phase of said vibration plate is transformed; and further comprising a substrate installed under said vibration plate and having a space portion for allowing said vibration plate to phase-transform.

2. An apparatus for injecting a recording solution of a print head as claimed in claim 1, wherein said thin film shape memory alloy is comprised of said shape memory alloy, using titanium (Ti) and nickel (Ni) as main substances.

3. An apparatus for injecting a recording solution of a print head as claimed in claim 1, wherein said thin film shape memory alloy has a thickness of about 0.3 $\mu$m to 5 $\mu$m.

4. An apparatus for injecting a recording solution of a print head as claimed in claim 1, wherein said second thin film has a thickness of about 0.1 $\mu$m to 3 $\mu$m.

5. An apparatus for injecting a recording solution of a print head as claimed in claim 1, wherein said second thin film is comprised of a thermally-grown silicon dioxide ($SiO_2$).

6. An apparatus for injecting a recording solution of a print head as claimed in claim 1, wherein said second thin film is comprised of a polysilicon.

7. An apparatus for injecting a recording solution of a print head as claimed in claim 1, wherein said electric power supply section comprises a heater formed to one side of said vibration plate for heating said thin film shape memory alloy by using the supplied electric power.

8. An apparatus for injecting a recording solution of a print head as claimed in claim 1, further comprising a radiating plate formed to one side of said vibration plate for radiating heat when said thin film shape memory alloy is cooled down after being heated.

9. An apparatus for injecting a recording solution of a print head as claimed in claim 8, wherein said radiating plate is comprised of a nickel (Ni) having an excellent thermal conductivity.

10. An apparatus for injecting a recording solution of a print head as claimed in claim 1, wherein an area of said vibration plate substantially phase-transformed by being exposed to said space portion has a width ranging from 100 μm to 500 μm and a length ranging from 100 μm to 300 μm.

11. An apparatus for injecting a recording solution of a print head as claimed in claim 1, wherein said vibration plate is straightened in the form of a flat plate when said thin film shape memory alloy is heated by an austenite finishing temperature to be transformed into an austenite and is bending-deformed by said residual compressive stress of said second thin film when said thin film shape memory alloy is cooled down by a martensite finishing temperature to be transformed into a martensite.

12. An apparatus for injecting a recording solution of a print head as claimed in claim 11, wherein said austenite finishing temperature of said thin film shape memory alloy is approximately 50° C. to 90° C., and said martensite finishing temperature is approximately 40° C. to 70° C.

13. An apparatus for injecting a recording solution of a print head as claimed in claim 11, wherein a time required for cooling down said thin film shape memory alloy to be said martensite after heating said austenite is shorter than approximately 200 μsec and said operating frequency is 5 kHz and higher.

14. An apparatus for injecting recording solution of a print head, comprising:

vibration plates having a thin film shape memory alloy of a shape memory alloy phase-transformed in accordance with a temperature variation and at least one second thin film coupled to said film shape memory alloy for regulating the phase transforming quantity;

an electric power supply section for inciting said temperature variation of said thin film shape memory alloy;

a passage plate installed over said thin film shape memory alloy, and being formed with liquid chambers for retaining said recording solution and formed with a feed path in at least one side of at least one wall plane surrounding each of said liquid chambers for introducing said recording solution;

a nozzle plate installed over said passage plate and formed with nozzles having dimensions smaller than those of said liquid chambers of said passage plate for enabling said recording solution to be injected in the form of droplet when said phase of said vibration plate is transformed;

wherein said thin shape memory alloy is comprised of said shape memory alloy, using titanium (Ti) and nickel (Ni) as main substances;

wherein said thin film is comprised of said shape memory alloy and copper (Cu) added to said alloy for heightening an operating frequency by reducing a temperature difference which incites the phase transformation.

15. An apparatus for injecting recording solution of a print head, comprising:

vibration plates having a thin film shape memory alloy of a shape memory alloy phase-transformed in accordance with a temperature variation and at least one second thin film coupled to said film shape memory alloy for regulating the phase transforming quantity;

an electric power supply section for inciting said temperature variation of said thin film shape memory alloy;

a passage plate installed over said thin film shape memory alloy, and being formed with liquid chambers for retaining said recording solution and formed with a feed path in at least one side of at least one wall plane surrounding each of said liquid chambers for introducing said recording solution;

a nozzle plate installed over said passage plate and formed with nozzles having dimensions smaller than those of said liquid chambers of said passage plate for enabling said recording solution to be injected in the form of droplet when said phase of said vibration plate is transformed;

wherein said electric power supply section comprises electrodes connected to ends of said thin film shape memory alloy for permitting said thin film shape memory alloy to generate heat as a result of the resistance of said alloy.

16. An apparatus for injecting recording solution of a print head comprising:

vibration plates having a thin film shape memory alloy of a shape memory alloy phase-transformed in accordance with a temperature variation and at least one second thin film coupled to said film shape memory alloy for regulating the phase transforming quantity;

an electric power supply section for inciting said temperature variation of said thin film shape memory alloy;

a passage plate installed over said thin film shape memory alloy, and being formed with liquid chambers for retaining said recording solution and formed with a feed path in at least one side of at least one wall plane surrounding each of said liquid chambers for introducing said recording solution;

a nozzle plate installed over said passage plate and formed with nozzles having dimensions smaller than those of said liquid chambers of said passage plate for enabling said recording solution to be injected in the form of droplet when said phase of said vibration plate is transformed;

further comprising a radiating plate formed to one side of said vibration plate for radiating heat when said thin film shape memory alloy is cooled down after being heated;

wherein said radiating plate has a thickness of about 0.5 μm to 3 μm.

17. A method for producing injecting apparatus of recording solution of a print head comprising:

forming a second thin film on a substrate to provide a residual compressive stress;

depositing a thin film shape memory alloy onto said second thin film to form a vibration plate;

performing annealing upon said thin film shape memory alloy to making a flat plate memorize as an austenite;

partially etching said substrate to expose a portion of said vibration plate; and bending-deforming the exposed portion of said vibration plate be said residual compressive stress of said second thin film;

whereby said steps, injecting said recording solution while said thin shape memory alloy is heated to be changed into said flat plate form;

refilling the inside of a liquid chamber with said recording solution while said thin film shape memory alloy is bending-deformed by said residual compressive stress of said second thin film when being cooled to be changed into said martensite.

18. An actuator of an apparatus for injecting a recording solution of a print head comprising:

vibration plates having a thin film shape memory alloy of a shape memory alloy phase-transformed in accordance with a temperature variation and at least one second thin film coupled to said thin film shape memory alloy for regulating the phase transforming quantity;

an electric power supply section for inciting said temperature variation of said thin film shape memory alloy;

a passage plate installed over said thin film shape memory alloy, and being formed with liquid chambers for retaining said recording solution and formed with a feed path in at least one side of at least one wall plane surrounding each of said liquid chambers for introducing said recording solution;

a nozzle plate installed over said passage plate and formed with nozzles having dimensions smaller than those of said liquid chambers of said passage plate for enabling said recording solution to be injected in the form of droplet when said phase of said vibration plate is transformed; and a substrate installed under said vibration plate and having said space portion for allowing said vibration plate to phase-transform.

19. An actuator of an apparatus for injecting a recording solution of a print head as claimed in claim 18, wherein said thin film shape memory alloy is comprised of said shape memory alloy, using titanium (Ti) and nickel (Ni) as main substances.

20. An actuator of an apparatus for injecting a recording solution of a print head as claimed in claim 18 wherein said thin film shape memory alloy has a thickness of about 0.5 $\mu$m.

21. An actuator of an apparatus for injecting a recording solution of a print head as claimed in claim 18, wherein said second thin film has a thickness of about 0.1 $\mu$m to 3 $\mu$m.

22. An actuator of an apparatus for injecting a recording solution of a print head as claimed in claim 18, wherein said second thin film is comprised of a thermally-grown silicon dioxide ($SiO_2$).

23. An actuator of an apparatus for injecting a recording solution of a print head as claimed in claim 18, wherein said second thin film is comprised of a polysilicon.

24. An actuator of an apparatus for injecting a recording solution of a print head as claimed in claim 18, wherein said electric power supply section comprises a heater formed to one side of said vibration plate for heating said thin film shape memory alloy by using the supplied electric power.

25. An actuator of an apparatus for injecting a recording solution of a print head as claimed in claim 18, further comprising a radiating plate formed to one side of said vibration plate for radiating heat when said thin film shape memory alloy is cooled down after being heated.

26. An actuator of an apparatus for injecting a recording solution of a print head as claimed in claim 25, wherein said radiating plate is comprised of a nickel (Ni) having an excellent thermal conductivity.

27. An actuator of an apparatus for injecting a recording solution of a print head as claimed in claim 18, wherein an area of said vibration plate substantially phase-transformed by being exposed to said space portion has a width ranging from 100 $\mu$m to 500 $\mu$m and a length ranging from 100 $\mu$m to 300 $\mu$m.

28. An actuator of an apparatus for injecting a recording solution of a print head as claimed in claim 18, wherein said substrate is comprised of a single-crystalline silicon substance.

29. An actuator of an apparatus for injecting a recording solution of a print head as claimed in claim 18, wherein said vibration plate is straightened in the form of a flat plate when said thin film shape memory alloy is heated by an austenite finishing temperature to be transformed into an austenite and is bending-deformed by said residual compressive stress of said second thin film when said thin film shape memory alloy is cooled down by a martensite finishing temperature to be transformed into a martensite.

30. An actuator of an apparatus for injecting a recording solution of a print head as claimed in claim 29, wherein said austenite finishing temperature of said thin film shape memory alloy is approximately 50° C. to 90° C., and said martensite finishing temperature is approximately 40° C. to 70° C.

31. An actuator of an apparatus for injecting a recording solution of a print head as claimed in claim 29, wherein a time required for cooling down said thin film shape memory alloy to be said martensite after heating said austenite is shorter than approximately 200 $\mu$sec and said operating frequency is 5 kHz and higher.

32. An actuator of an apparatus for injecting a recording solution of a print head comprising:

vibration plates having a thin film shape memory alloy of a shape memory alloy phase-transformed in accordance with a temperature variation and at least one second thin film coupled to said thin film shape memory alloy for regulating the phase transforming quantity;

an electric power supply section for inciting said temperature variation of said thin film shape memory alloy;

a passage plate installed over said thin film shape memory alloy, and being formed with liquid chambers for retaining said recording solution and formed with a feed path in at least one side of at least one wall plane surrounding each of said liquid chambers for introducing said recording solution;

a nozzle plate installed over said passage plate and formed with nozzles having dimensions smaller than those of said liquid chambers of said passage plate for enabling said recording solution to be injected in the form of droplet when said phase of said vibration plate is transformed; and a substrate installed under said vibration plate and having a space portion for allowing said vibration plate to phase-transform;

wherein said thin film is comprised of said shape memory alloy and copper (Cu) added to said alloy for heightening an operating frequency by reducing a temperature difference which incites the phase transformation.

33. An actuator of an apparatus for injecting a recording solution of a print head comprising:

vibration plates having a thin film shape memory alloy of a shape memory, alloy phase-transformed in accordance with a temperature variation and at least one second thin film coupled to said thin film shape memory alloy for regulating the phase transforming quantity;

an electric power supply section for inciting said temperature variation of said thin film shape memory alloy;

a passage plate installed over said thin film shape memory alloy, and being formed with liquid chambers for retaining said recording solution and formed with a feed path in at least one side of at least one wall plane surrounding each of said liquid chambers for introducing said recording solution;

a nozzle plate installed over said passage plate and formed with nozzles having dimensions smaller than those of said liquid chambers of said passage plate for enabling said recording solution to be injected in the form of droplet when said phase of said vibration plate is transformed; and a substrate installed under said vibration plate and having a space portion for allowing said vibration plate to phase-transform;

wherein said electric power supply section comprises electrodes connected to ends of said thin film shape memory alloy for permitting said thin film shape memory alloy to generate heat as a result of the resistance of said alloy.

34. An actuator of an apparatus for injecting a recording solution of a print head comprising:

vibration plates having a thin film shape memory alloy of a shape memory alloy phase-transformed in accordance with a temperature variation and at least one second thin film coupled to said thin film shape memory alloy for regulating the phase transforming quantity;

an electric power supply section for inciting said temperature variation of said thin film shape memory alloy;

a passage plate installed over said thin film shape memory alloy, and being formed with liquid chambers for retaining said recording solution and formed with a feed path in at least one side of at least one wall plane surrounding each of said liquid chambers for introducing said recording solution;

a nozzle plate installed over said passage plate and formed with nozzles having dimensions smaller than those of said liquid chambers of said passage plate for enabling said recording solution to be injected in the form of droplet when said phase of said vibration plate is transformed; and a substrate installed under said vibration plate and having said space portion for allowing said vibration plate to phase-transform;

further comprising a radiating plate formed to one side of said vibration plate for radiating heat when said thin film shape memory alloy is cooled down after being heated;

wherein said radiating plate has a thickness of about 0.5 $\mu$m to 3 $\mu$m.

* * * * *